United States Patent [19]

Van Bogaert et al.

[11] Patent Number: 4,901,772

[45] Date of Patent: Feb. 20, 1990

[54] METHOD FOR ADJUSTING THE LENGTH OF THE WEFT THREAD TO BE INSERTED INTO THE SHED OF WEAVING LOOMS AND DEVICES USED FOR THIS OBJECT

[75] Inventors: Philippe Van Bogaert, Schaarbeek; Ampe Frank, Leffinge-Middelkerke, both of Belgium

[73] Assignee: Picanol N.V., Belgium

[21] Appl. No.: 355,127

[22] Filed: May 16, 1989

[30] Foreign Application Priority Data

Sep. 23, 1986 [BE] Belgium ..... 2/61057

[51] Int. Cl.[4] ..... D03D 47/36

[52] U.S. Cl. ..... 139/452; 139/450

[58] Field of Search ..... 139/435, 452, 450; 242/47.01, 47.11, 47.12

[56] References Cited

U.S. PATENT DOCUMENTS

| | | | |
|---|---|---|---|
| 3,411,548 | 11/1968 | Pfarrwaller | 139/452 |
| 4,607,668 | 8/1986 | Tholander | 139/452 |
| 4,623,007 | 11/1986 | Griffith | 139/452 |
| 4,667,706 | 5/1987 | Barten et al. | 139/452 |
| 4,744,393 | 5/1988 | Takegawa | 139/452 |
| 4,744,394 | 5/1988 | Linke | 139/452 |
| 4,746,848 | 5/1988 | Maenaka et al. | 139/452 |

FOREIGN PATENT DOCUMENTS

| | | | |
|---|---|---|---|
| 107110 | 5/1984 | European Pat. Off. | 139/452 |
| 28522 | 2/1985 | Japan | 139/452 |

*Primary Examiner*—Henry S. Jaudon

*Attorney, Agent, or Firm*—Bacon & Thomas

[57] ABSTRACT

Method and apparatus for adjusting the length of the weft thread to be inserted into the shed of weaving looms that provides an automatic correction of the weft thread length during each weaving cycle of the weaving process by adding to or substracting a variable amount of weft thread from the accumulated length of weft thread prior to insertion of the thread into the shed.

6 Claims, 2 Drawing Sheets

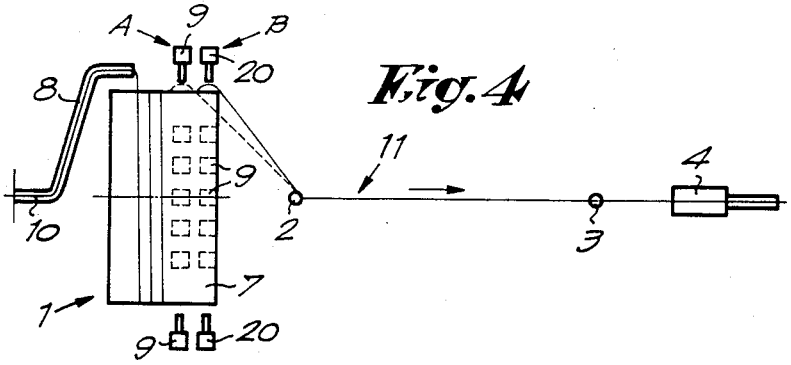
Fig. 4
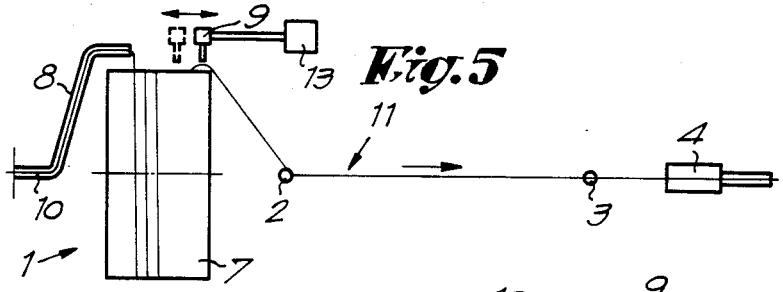
Fig. 5
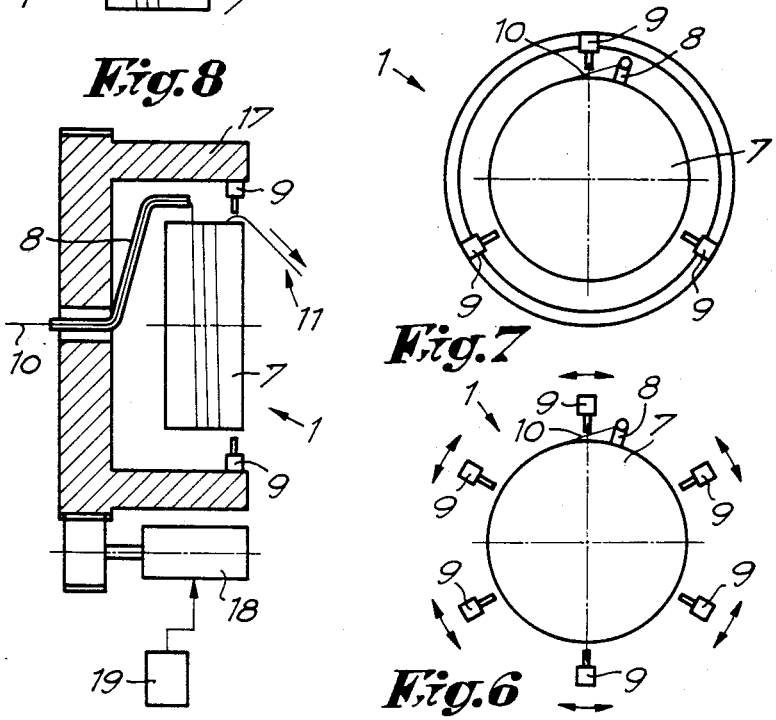
Fig. 8
Fig. 7
Fig. 6

METHOD FOR ADJUSTING THE LENGTH OF THE WEFT THREAD TO BE INSERTED INTO THE SHED OF WEAVING LOOMS AND DEVICES USED FOR THIS OBJECT

This application is a continuation of application Ser. No. 098,386, filed Sept. 18, 1987.

The object of the present invention is to provide a method and apparatus for adjusting the length of a weft thread to be inserted into the shed of a weaving loom.

BACKGROUND OF THE INVENTION

It is known in the weaving loom art that the weft thread of a weaving loom can be guided through a thread preparation device in such a way that predetermined weft thread lengths can be accumulated by the device prior to their insertion into the shed of the loom. According to known embodiments, use is made of a weft storing device equipped with a drum, with an electromagnetically actuated pin mounted at the front end of the drum on its periphery. In this device, the weft thread is accumulated in coils on the drum, and a given number of coils of weft thread are released from the drum between sequential actuations of the pin that retract the pin from the drum periphery.

The drum surface is mainly composed of several such pins which are located at spaced intervals around the circumference of the drum and which are radially movable to extend from the drum surface and engage the weft thread in order to achieve a length adjustment of the weft thread length accumulated on the drum. The adjustments of the weft thread length must be carried out manually beforehand, prior to weft insertion. Quite obviously, this is a tedious job that renders automatic adjustment of the weft thread impossible.

It is also known to provide several thread locking elements along the periphery of the aforesaid drum, for example, the magnetically actuated pins, in such a way that less than a complete turn or coil of thread is released from the drum at each actuation of the electromagnetic pins.

Such a device has, however, the disadvantage that automatic adjustment can only achieve a step-wise length adjustment of the length of thread accumulated and that, consequently, in order to make a sufficient adjustment of the thread length, a small thread length in excess of what is needed for the adjustment is lost for each weft thread length accumulated. In this respect, it should not be forgotten that even a small thread excess for each weft thread length accumulated for insertion corresponds to a relatively large total weft thread loss for the woven fabric.

SUMMARY OF THE INVENTION

Thus, the object of the present invention is to provide a method of adjusting the accumulated length of the weft thread to be inserted into the shed of weaving looms, whereby the method does not have the aforesaid disadvantages. The method mainly comprises the automatic correction of the accumulated weft thread length during the weaving process, including adding to or substracting from the length of the accumulated weft thread that is released from the storage drum at each insertion in such a way that at each insertion the desired thread length is inserted into the shed.

According to the first embodiment of the invention, the length of the accumulated weft thread is automatically increased or decreased by variable amounts by guiding the weft thread at the weft insertion side of the shed along a path having an adjustable path length. According to another embodiment, a weft accumulating device is used, whereby along the periphery of the drum of this accumulating device thread locking elements are provided, which can be displaced automatically in a radial direction with respect to the surface of the drum in order to adjust the length of the weft thread coiled on the drum.

The present invention concerns both the method and the devices which perform the method of the invention described hereinafter.

BRIEF DESCRIPTION OF THE DRAWINGS

In order to explain the characteristics of the invention, several preferred embodiments of the invention are described hereafter by way of examples, without any limitative intent and with reference to the following drawing figures in which:

FIG. 4 is a schematic view of an additional embodiment of the invention where a drum of a weft storing device is equipped with several rows of electromagnetic pins spaced around the periphery of the drum.

FIG. 5 is a schematic view of an additional embodiment of the invention where a drum of a weft storing device is equipped with an axially movable thread locking element.

FIG. 6 is a schematic end view of an embodiment of the invention similar to that of FIG. 5 where the thead locking elements may be adjusted rotatively around the drum of the weft storing device by rotating the elements relative to the drum.

FIG. 7 is a schematic view of an alternative embodiment similar to the embodiment shown in FIG. 6.

FIG. 8 is a schematic cross-section of the embodiment of FIG. 7.

DESCRIPTION OF THE PREFERRED EMBODIMENTS

Figure 1:
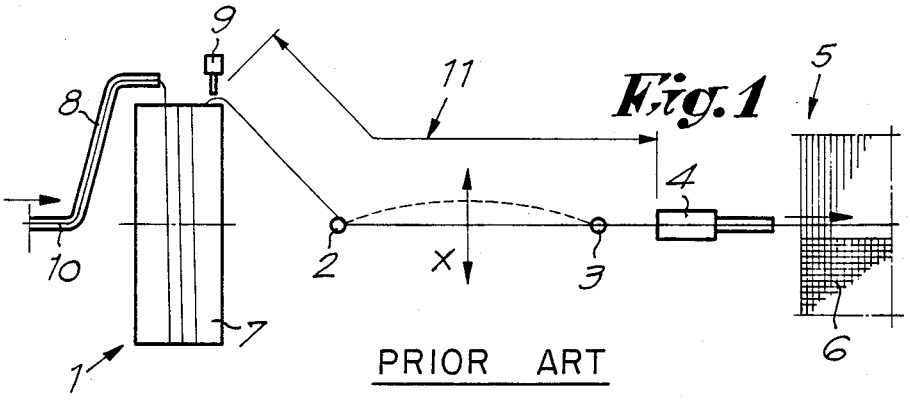
Fig. 1 PRIOR ART
FIG. 1 is a schematic view of a first embodiment of the method of the invention.

FIG. 1 illustrates schematically a conventional weft thread accumulating device including: a weft storing device 1, two stationary thread guiding elements 2 and 3, a main blower 4 for insertion of weft thread into a shed and the weft insertion side 5 of the shed 6. The weft storing device 1 may be a conventional stationary or rotatable weft storing drum 7 combined with, respectively, a rotatable or stationary coiling arm 8. The weft storing device also comprises a locking element 9 which can be electromagnetically actuated for example, a solenoid operated axially engaging pin.

In the method of FIG. 1, a weft thread 10 is coiled on the drum 7 in a well known manner of operation of such a conventional accumulating device. The periodic actuation of the locking element 9 retracting it from the surface of the drum 7 and the pulling force on the accumulated weft exerted by the main blower 4 results in the removal of a given number of coils of weft from the drum at the moment of weft insertion into the shed 6. According to the present invention, the weft thread in the conventional accumulator is now guided from the locking element 9 to the main blower 4 along a path 11 having an adjustable path length. For example, the path length of the weft thread 10 may be adjusted by moving the segment of the path between the stationary thread guiding elements 2 and 3 in a horizontal direction indicated by arrow X to a position indicated by the phantom line between elements 2 and 3.

Figure 2:
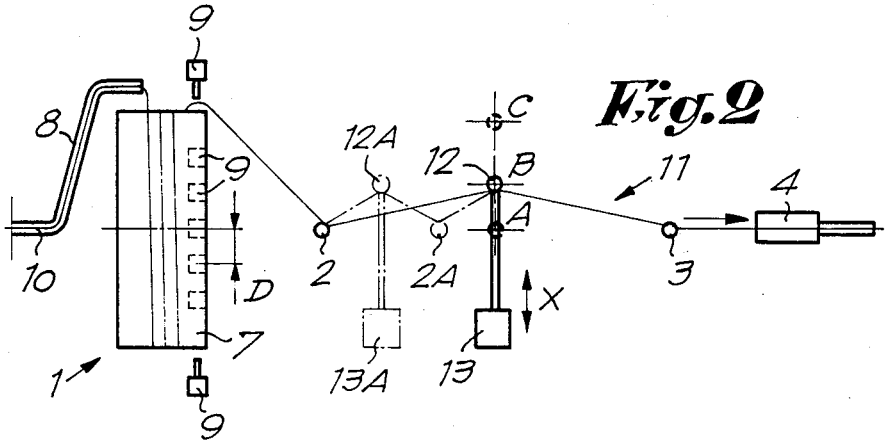
FIGS. 2 and 3 are schematic views of two different embodiments of the apparatus of the invention for practicing the method of the invention described with reference to FIG. 1.
Figure 3:
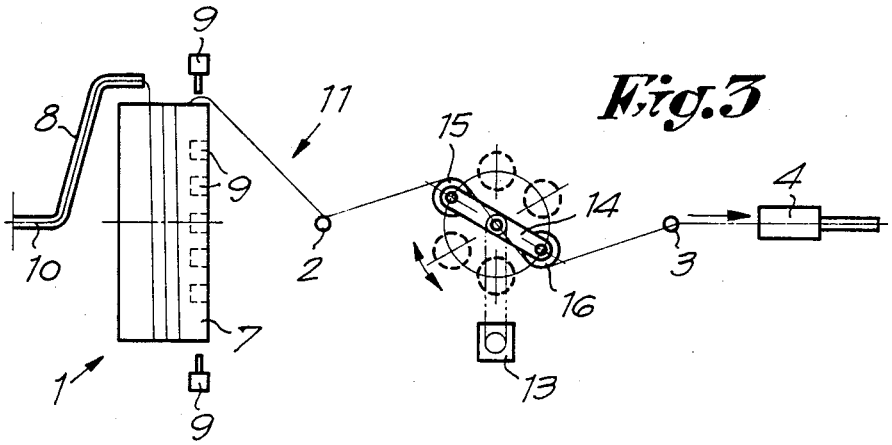

The method of adjusting the length of accumulated weft thread described above can be achieved, for instance, with the devices illustrated in FIGS. 2 and 3. In FIG. 2, the invention device for practicing the above described method of adjustment includes a thread guiding element 12 comprising a thread eyelet, which is placed between the aforesaid stationary guiding elements 2 and 3 in the path of weft thread travel from the storing device 1 to the main blower 4. The element 12 is equipped with a driving means 13 which is actuated by a control device (not shown) in such a way that the eyelet of the guiding element 12 is moved to vary the length of the weft path so that an adequate length of weft thread 10 can always be inserted into the shed 6.

Preferably, the aforesaid embodiment of the invention is used according to the following method. At the moment of the insertion of the accumulated weft thread on the drum 7 and along the path 11, the thread guiding element 12 is maintained in the A position to provide a straight weft travel path between the stationary guides 2 and 3 and in order to avoid braking of the thread. At the end of a weft insertion and before the adjustment of the accumulated length of weft thread 10, the thread guiding element 12 is automatically moved horizontally to the C position in order to ensure that the weft thread is not pulled backward out of the main nozzle during the adjustment of the exact length. Finally, the thread guiding element 12 is automatically moved to a B position which is the predetermined position of the eyelet required in order to provide an exact length of the weft thread accumulated on the drum 7 and along the adjusted path length 11 for the next pick insertion.

Quite obviously, the adjustment made along the horizontal direction X can occur in a number of different ways and is strongly dependent upon the distance D between two successive locking elements 9 spaced around the periphery of the drum 7.

If, for instance, the total desired length of the weft thread to be inserted is equal to 40.5 times the arc distance D between two successive thread locking elements 9, the actuation of the thread locking elements 9 is automatically controlled so that a thread length equal to 41 times the distance D is released from the drum while the thread guiding element 12 is automatically moved to a horizontal position B which has been predetermined to increase the total length of the weft thread path corresponding to an additional elongation of the thread length equal to 40 times the distance D by an amount equal to 0.5 times the distance D, resulting in a total length of 40.5 times the distance D. At the following insertion, the thread guiding element 12 is automatically moved back in the A position and a length of weft thread equal to 40 times D is released from the drum, resulting in the insertion into the shed 6 of a weft thread 10 having a total length of 40.5D.

Quite obviously, it is possible to provide more than one adjustable thread guiding element 12 along the weft thread path between the stationary guides 2 and 3. FIG. 2 illustrates in phantom lines an additional embodiment of the invention comprising a second adjustable thread guiding element 12A as well as an additional stationary thread guiding element 2A which is mounted between both movable thread guiding elements 12 and 12A.

According to an additional embodiment shown in FIG. 3, the elongation of the weft thread path length between the thread guiding elements 2 and 3 is achieved using an automatically rotating device 14 which is equipped with rolls 15 and 16. The weft thread 10 is guided through the stationary guide 2, in a zig-zag manner between the rolls 15 and 16 of the rotating device 14, and through the stationary guide 3. When the rotating device 14 is rotated over a predetermined angle less than 180° C. by means of driving device 13, the desired effect of adjusting the length of accumulated weft thread can also be obtained in accordance with the invention. The functioning of the device to increase the length of the weft thread is clearly apparent from FIG. 3.

According to an alternative embodiment of the invention, not shown in the drawing figures, the accumulated weft thread length adjustment occurs by moving the thread eyelets 2 and 3 with respect to each other.

FIG. 4 illustrates still another alternative embodiment of the present invention. Use is made of two or more rows of the electromagnetic locking elements 9 and 20 spaced around the periphery of the drum 7 and which are selectively actuated in such a way that the length of weft thread accumulated between a locking element 9 and the main blower 4, and more specifically between the locking element 9 and the stationary thread guiding element 2 can be automatically adjusted by selective actuation of locking elements 9 and 20 in each row. In such a case, two rows of locking elements A and B are provided. The phantom line indicating the adjustment of the path 11 in FIG. 4 clearly shows that if an electromagnetic element 20 from row B is or is not energized in combination with an electromagnetic element 9 from row A, it is possible to adjust the path length segment 11 and the total path length of accumulated weft thread coiled on the drum and along the path 11.

In an additional embodiment shown in FIG. 5, use is made of a weft storing device 1 composed of a drum 7 as is well known in the art, of a coiling arm 8 and of one or several thread locking elements 9 mounted stationary relative to the drum and spaced around the periphery of the drum 7. The elements 9 may be electromagnetically actuated pins as in the previous embodiments. According to this embodiment of the present invention, the desired length of weft thread 10 is accumulated on the drum while retained by the locking element 9, and is released from the drum by actuation of the electromagnetic locking element. The locking element 9 may be automatically moved axially across the surface of the drum to adjust the length of the weft thread accumulated for insertion into the shed. By moving the locking element axially, the path length between the locking element 9 and the main blower 4 is adjusted. In an additional embodiment not shown, several thread locking elements 9 may be provided along a common axial path.

FIG. 6 illustrates schematically still another alternative embodiment of the invention where the thread locking elements 9 spacially arranged around the drum can be moved separately a predetermined distance in a tangential direction with respect to the drum. In this way the path length of the accumulated weft thread may also be adjusted in a similar manner to that of the embodiment of FIG. 5.

According to another alternative embodiment illustrated in FIG. 7, the adjustment of the length of the released weft path is achieved when the aforesaid thread locking elements are moved together a predetermined distance in a tangential direction with respect to the drum 7. The movement of the locking elements around the drum for adjusting the weft length can be achieved, for instance, by means of the device illustrated in FIG. 8, where the ring-shaped part 17 supporting the thread locking elements 9 is rotated relative to the drum through a gear transmission by means of a step motor or a servometer 18 which is actuated by a control device 19, for example an electronic circuit. The adjustment of the thread length is achieved in the above embodiment in the following way: if 40.5D of accumulated weft is desired, 40 D is accumulated in coils on the drum and the electromagnetic elements 9 are rotated 0.5 D further around the drum so that a total accumulated weft thread length of 40.5 D is obtained.

Quite obviously, the present invention can be put into practice according to different alternative embodiments and combinations without department from the scope of the invention.

Moreover, the method of the invention, as described above, is also applicable to thread preparation systems that do not include a weft storing drum 7.

Devices, as illustrated in FIGS. 1–3 may also be applied to weaving looms which are equipped with thread preparation devices where the weft thread 10 is accumulated by being blown in the shape of a loop. With this type of accumulator, the invention device could be placed before the thread preparation device instead of behind it.

The present invention is by no means intended to be limited to the embodiments described by way of examples and illustrated in the figures herein, and devices for practicing the method of the invention can be built according to various designs without leaving the scope of the invention.

I claim:

1. In a method of controlling insertion of a weft thread into a weaving loom shed, said method including the steps of: (i) releasing the thread from an accumulator to allow insertion of a length of thread into the shed by an insertion device, and (ii) stopping release of the thread from the accumulator after a predetermined length of thread has been released, the improvement comprising the step of adjusting the length of a path traversed by the thread between the accumulator and the insertion device such that the length of thread inserted into the shed is different from said predetermined length released from the accumulator.

2. A method as claimed in claim 1, wherein the steps of releasing and stopping are cyclically repeated, and the path length is adjusted by alternately increasing and decreasing said path length by predetermined amounts once every releasing and stopping cycle.

3. In an apparatus for controlling insertion of a weft thread into a weaving loom shed, said apparatus including an accumulator, an insertion device, and releasing and stripping means for releasing the thread from the accumulator to allow insertion of a length of thread into the shed by the insertion device and for stopping release of the thread after a predetermined amount of thread has been released from the accumulator, the improvement comprising means for adjusting the length of a path traversed by the thread between the accumulator and the insertion device such that said length of thread inserted into the shed is different from said predetermined amount released from the accumulator.

4. An apparatus as claimed in claim 3, wherein said adjusting means includes a thread guiding element mounted between said accumulator and said shed, said thread guiding element contacting the thread along said path to guide the thread, and wherein said thread guiding element is arranged to be movable in a direction substantially perpendicular to the direction of said path.

5. A method of controlling insertion of a weft thread into a weaving loom shed, the weaving loom including an accumulator drum defining an axis, said method including the steps of: (i) releasing the thread from the accumulator drum to allow insertion of a length of thread into the shed by an insertion device, and (ii) stopping release of the thread from the accumulator drum after a predetermined length of thread has been released, the improvement comprising the step of adjusting, in the direction of said axis, the position of a thread locking element that performs the functions of releasing and stopping release of the thread.

6. An apparatus for controlling insertion of a weft thread into a weaving loom shed, said apparatus including an accumulator drum defining an axis, an insertion device, and releasing and stopping means for releasing the thread from the accumulator drum to allow insertion of a length of thread into the shed by the insertion device and for stopping release of the thread after a predetermined amount of thread has been released from the accumulator drum, said releasing and stopping means including a locking element arranged to move radially in respect to said drum axis to perform the functions of releasing the thread and stopping release of the thread, the improvement comprising means for adjusting the length of a path traverserved by the thread between the accumulator drum and the insertion device by moving said locking element in a direction substantially parallel to said axis.

* * * * *

UNITED STATES PATENT AND TRADEMARK OFFICE

CERTIFICATE OF CORRECTION

PATENT NO. : 4,901,772

DATED : February 20, 1990

INVENTOR(S) : Philippe VAN BOGAERT et al

It is certified that error appears in the above-identified patent and that said Letters Patent is hereby corrected as shown below:

On the front cover sheet, please add:

"Related U.S. Application Data:

[63] Continuation of Ser. No. 98,386, Sept. 18, 1987, abandoned."

Signed and Sealed this

Twenty-sixth Day of March, 1991

*Attest:*

HARRY F. MANBECK, JR.

*Attesting Officer*

*Commissioner of Patents and Trademarks*